United States Patent [19]

Fröhlich et al.

[11] 4,362,191

[45] Dec. 7, 1982

[54] WOVEN SLIDE-FASTENER STRINGER

[75] Inventors: Alfons Fröhlich; Karl Griessbaum, both of Essen, Fed. Rep. of Germany

[73] Assignee: Opti Patent-, Forschungs-und Fabrikations AG, Riedern-Allmeind, Switzerland

[21] Appl. No.: 195,000

[22] Filed: Oct. 9, 1980

[30] Foreign Application Priority Data

Oct. 10, 1979 [DE] Fed. Rep. of Germany ..... 2941067

[51] Int. Cl.[3] ..... D03D 1/00; A44B 19/40; A44B 19/34

[52] U.S. Cl. ..... 139/384 B; 24/205.16 C

[58] Field of Search ..... 139/384 B, 384 R, 116; 24/205.1 C, 205.13 C, 205.16 C

[56] References Cited

U.S. PATENT DOCUMENTS

| | | | |
|---|---|---|---|
| 3,847,188 | 11/1974 | Auer et al. | 139/384 B |
| 3,961,652 | 6/1976 | Hasuda et al. | 139/384 B |
| 4,135,555 | 1/1979 | Mausbach | 139/384 B |
| 4,334,556 | 6/1982 | Fröhlich et al. | 139/384 B |

FOREIGN PATENT DOCUMENTS

| | | | |
|---|---|---|---|
| 1945315 | 3/1971 | Fed. Rep. of Germany | 24/205.16 C |

*Primary Examiner*—James Kee Chi

*Attorney, Agent, or Firm*—Karl F. Ross

[57] ABSTRACT

A slide-fastener stringer has a tape formed from a ground weave with double wefts interwoven with a warp and a coupling element disposed along the edge of the tape and held thereto by binding warps. The coupling element is of the type in which a synthetic resin monofilament is coiled to form coupling heads whose shanks are disposed one above the other so that they have a common projection in the slide fastener plane. The shanks are connected to those of successive heads by bights. The coupling warp comprises a plurality of warp yarns whose patterns are offset by two picks and which each pass over two coupling elements, under a double weft between coupling elements, over another coupling element and then under the next coupling element in a repeating pattern.

2 Claims, 3 Drawing Figures

WOVEN SLIDE-FASTENER STRINGER

FIELD OF THE INVENTION

Our present invention relates to a slide fastener of the woven-tape type and, more particularly, to slide fasteners with woven stringer tapes with continuous coupling elements mounted along edges thereof and fixed in the weave.

BACKGROUND OF THE INVENTION

A slide fastener generally comprises a pair of stringer tapes along confronting edges of which are mounted rows of coupling heads or teeth which interdigitate upon movement of a slider along these rows. The tapes and the rows of coupling heads form stringers and the slide fastener may be provided at its ends with stop members preventing withdrawal of a slider, means for coupling the two tapes or slide-fastener halves together in the case of a nonseparable slide fastener, or male and female formations enabling the coupling and decoupling of the stringer halves in the case of a separable slide fastener.

The tapes generally are incorporated in opposite sides of an article having an opening which can be closed by the slide fastener, e.g. by stitching.

The slide-fastener art has advanced rapidly in recent years both with respect to techniques for the fabrication of the stringers and with respect to improvements in the mechanical and esthetic properties thereof. For example, woven support tapes which have hitherto been provided with the coupling heads by clamping, molding or rows of stitching, have increasingly been provided with the heads directly during the tape-weaving operation utilizing conventional tape looms which can be modified to allow the coupling heads to be mounted on the edges of the tape as the tape is woven.

In recent years, moreover, individually mounted coupling heads have tended to be replaced by continuous coupling elements composed of a synthetic resin monofilament and of coil or meander configuration. The individual coupling heads can be formed by deforming bending or kinking the monofilament at spaced-apart locations to so deform the head that it has lateral protrusions which can engage behind the heads of the opposing coupling element when the two are interdigitated, i.e. when the heads of one coupling element are fitted into the interstices or head spaces of the opposing coupling element.

The heads have shanks which reach toward the respective tapes and can be connected to the shanks of adjoining heads by connecting members or bights. Each head and the associated pair of shanks will be referred to hereinafter as a coupling member and because coils of the type described have a generally dentate configuration, the coupling heads or coupling members may be referred to as "teeth".

In referring to woven support tapes, reference will be made to the ground weave which, of course, is intended to mean the woven fabric consisting of weft yarns and warp yarns, to which the coupling element is secured. A ground weft is, therefore, a weft yarn structure of the ground weave. A "double weft" is a weft of a single yarn having two passes received in the same warp pockets or sheds in traversing the tape.

It is known, e.g. from German open application (Offenlegungsschrift) DE-OS No. 2 219 907 and the corresponding U.S. Pat. No. 3,880,203 issued Apr. 20, 1975 to Alfons Fröhlich, one of the present joint inventors, to provide stringer tapes which are composed of warp yarns and double wefts formed from a continuous ground weft yarn with the coupling element being woven into the tape or secured to the tape by weaving. In this case, the two shanks of each coupling member can also form a double weft which is secured to the ground weave by warp yarns at least in part.

The teeth or coupling members have their shanks superposed, i.e. an upper shank lies directly over a lower shank so that the two shanks or each coupling member and connected to a respective coupling head, have a common projection in the slide fastener plane. In this construction, moreover, double wefts of the ground weft yarns are disposed between the coupling members. These double ground wefts can be received in their own warp yarn pockets, i.e. the pockets in the warp resulting from shedding the warp during weaving and defined as the pockets between consecutive crossings of the warp in warp patterning.

In the stringers of the type of concern here, best represented by FIGS. 12 and 14 of the aforementioned publications, the warp yarn pockets do not receive a complete coupling member but rather receive only the bottom shank of one coupling member and the top shank of an adjacent coupling member so that there are no warp pockets individual to or exclusively assigned to discrete coupling members.

While the stringer of these publications has been found to be excellent for most purposes, it is susceptible to damage by a sharp transverse pull upon the coupling elements toward the coupling head side and away from the tape. Furthermore, the aforementioned weaving attachment does not always provide satisfactory flexibility of the fastener.

It has been found also that longitudinal tension or stress upon the stringer tape, or shrinkage of the latter, has a tendency to vary the spacing or pitch between the teeth because the spacing between two shanks of different coupling members is received in a common warp pocket.

Finally, while the tapes with the coupling elements woven into place can be fabricated on conventional double-pick needle tape looms, the particular system of securing the coupling elements has been found to limit the speed at which the loom can operate.

OBJECTS OF THE INVENTION

It is the principal object of the present invention to provide a slide-fastener stringer which has improved softness and flexibility, and has a high degree of mechanical stability, especially pitch stability, under stresses of all types and in all directions, and which can be fabricated on modern automatic needle looms at high speeds.

Another object of the invention is to provide a slide-fastener stringer with improved attachment of the coupling elements to the support tapes.

SUMMARY OF THE INVENTION

These objects and others which will become apparent hereinafter are attained, in accordance with the present invention, in a woven slide-fastener stringer which comprises a ground weft having double wefts of a continuous weft yarn interwoven with the ground warp and lying in warp pockets thereof, and a coupling element along the respective edge of the woven ground weave having a plurality of spaced-apart coupling members of the synthetic resin monofilament with superposed shanks such that the shanks of each member have a common projection in the slide fastener plane and form a double weft which is secured to the tape by connective warp yarns.

The ground double wefts are positioned beneath the superposed shanks of each coupling member and between the coupling members.

According to a key feature of the invention, the connecting or securing warp yarns each are offset from other in the warp pattern by a stagger of two picks (i.e. two double wefts) and extend over a pair of coupling members, under the next interstitial ground double weft, over the next coupling member and under the next coupling member in a repeating pattern. The term "interstitial ground weft" is used to refer to the ground double weft between the pair of coupling members overshot by a warp yarn and the next coupling member also overshot by the same warp yarn.

According to another feature of the invention, the connecting warp yarns also engage between the single overshot coupling member and the next undershot coupling member, the interstitial double ground weft therebetween.

According to the invention, therefore, the ground double wefts or yarn and the monofilament double wefts are disposed in separate pockets of the ground weave and the connective weave, one beneath the other transverse to the fastener plane.

We have found that the result is a soft and flexible slide fastener since the stringer tape weft yarns and the tape as a whole can move in response to bending stresses relative to the rows of coupling members so that stress on the coupling elements is limited or precluded and kinking of the coupling element does not occur.

In spite of this limited mobility, the slide fastener has a stable interhead pitch which is not affected by dyeing, washing and ironing.

The technique of the invention can be utilized with extremely fine synthetic resin monofilament coupling elements as well as with relatively thick or coarse-gauge monifilament coupling elements provided that the thickness of the tape and yarns is selected accordingly.

Automatic needle looms for producing slide fasteners in accordance with the invention have been found to operate extremely fast to produce continuous stringer tapes and coupling elements from which individual slide-fastener lengths can be cut.

We have also found it to be advantageous to prevent the ground fabric from ravelling at the cut regions, to include stop warp yarns in the regions of the cuts, these warp yarns forming respective warp shed for each tooth with the stop yarns near the teeth extending between the double weft below the tooth or coupling member and the coupling member itself. In the region between the coupling members, the stop yarns can extend beneath the ground double weft. Most advantageously, the crossing places of the stop warp yarns are disposed above the plane of the stringer tape near the midsection in height of the coupling elements. This lifting of the crossing points can be achieved by control of the yarn tension.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
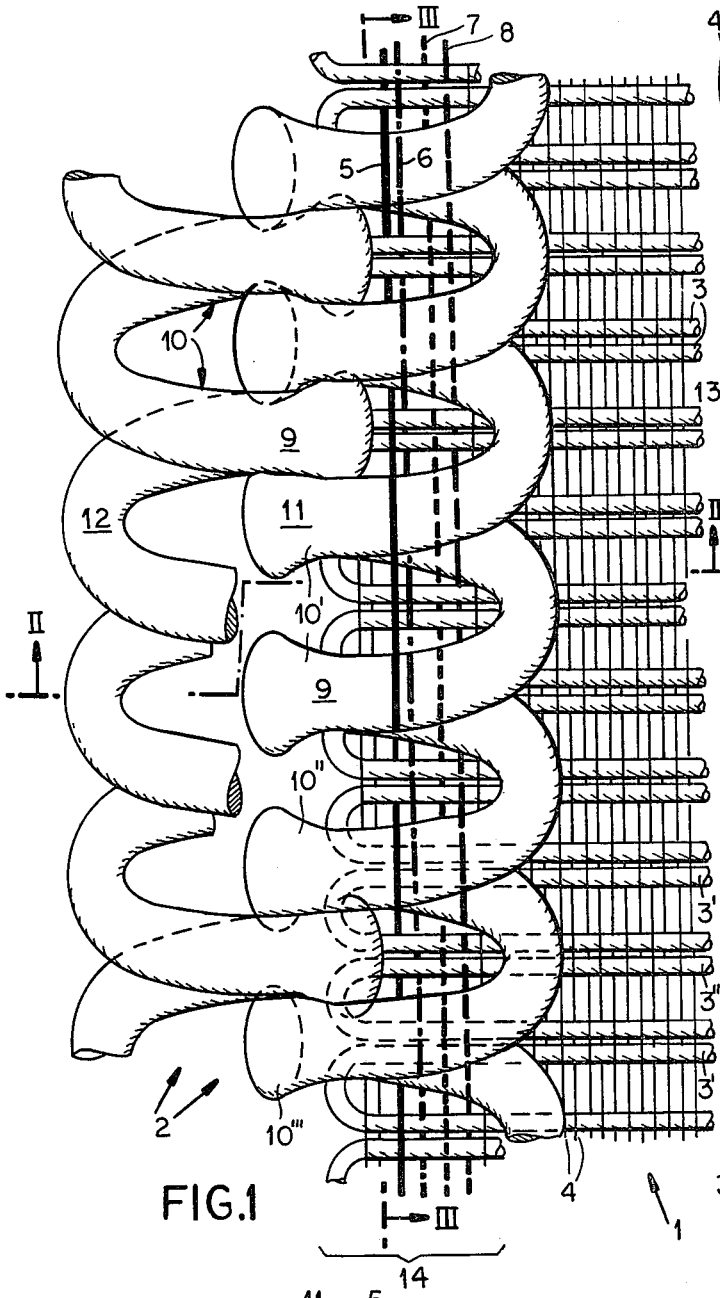
FIG. 1 is a diagrammatic plan view of a slide-fastener stringer embodying the invention and partially broken away.

The drawing shows, in greatly enlarged scale and highly diagrammatically, a portion of the stringer corresponding to one slide-fastener half with its coupling element interdigitated with a portion of a coupling element of the slide-fastener half whose tape has not been shown.

The stringer comprises woven stringer tapes 1 and connected by weaving thereto rows of coupling members in the form of a continuous coupling element 2 constituted by a snythetic resin monofilament produced during the weaving operation.

For the sake of clarity, the weft yarns 3 of the stringer tape 1 are shown in an exaggerated thickness whereas warp yarns 4 are shown in single line or, where they constitute the connecting warp, in heavy line or broken line as well be apparent hereinafter.

Figure 3:
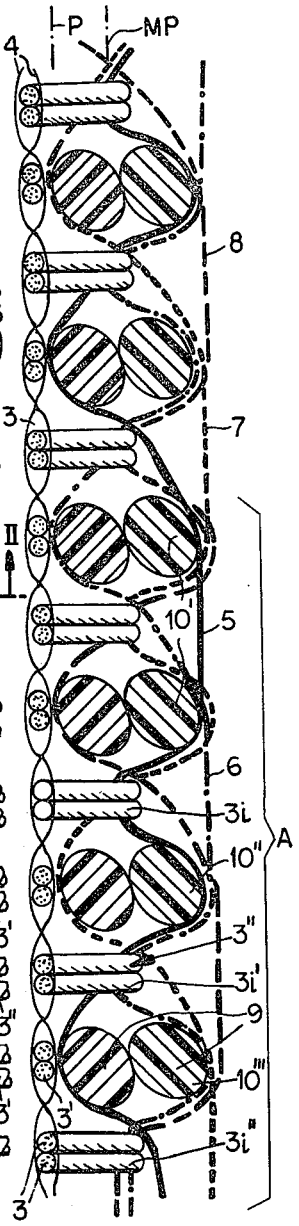
FIG. 3 is a section taken along the line III—III of FIG. 1.

In FIG. 3, for example, four connecting warp yarns 5–8 are shown. Yarn 5 is represented in solid line, yarn 6 by dot-dash line, the yarn 7 dotted line and yarn 8 by dash line.

The ground-weave tape 1 is constituted by the warp yarns 4 and double wefts of the continuous ground weft yarn 3.

The coupling members each have a coupling head 11 and a pair of shanks 9 which reach inward toward the tape and lie thereover in superposed relationship so that at least in the region adjoining the head, the shanks 9 have a common projection on the fastener plane for a given coupling member 10.

The coupling members are interconnected by connecting parts or bights 12.

Figure 2:
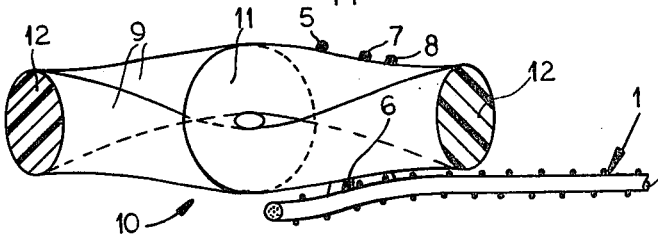
FIG. 2 is a section taken along the line II—II of FIG. 1.

The shanks 9 of each coupling member constitute a double weft. The double wefts of yarns 3 include double wefts 3' which lie beneath the coupling members (FIGS. 1 and 3) and double wefts 3'' which are interstitial double wefts in accordance with the definition given above and lie in the spaces between coupling members 10. The double weft 3 extends substantially to the junctions of the shanks 9 with the heads 11 which project beyond the tape to interdigitate, as shown in FIGS. 1 and 2, with the coupling element of the other stringer tape.

Since the yarns 5 through 8 pass over the coupling members and under the double weft yarns 3, the coupling element is secured to the stringer tape.

More specifically, and as can be seen from FIGS. 1 and 3, the tapes 1 have below the coupling elements 2 a portion 14 extending longitudinally of the fastener and formed by double wefts 3' and 3'' and the ground warp yarns 4. Stability of pitch or interhead spacing is assured by the presence of the double wefts 3'' between the teeth or coupling member 10.

The securing or connecting warp yarns 5–8 lie above the stringer tape plane P with an offset of two weft picks from one another in a repeating pattern. In this pattern, each of the connecting warp yarns 5–8 passes over a pair of coupling members 10 as represented at 10' in FIG. 1 for the yarn 5 and also overshoots the next coupling member 10'' while undershooting or passing under the following coupling member 10'''. In addition, and within the repetition pattern, each yarn 5–8, for example the yarn 5, passes under the interstitial double ground weft 3*i* between the pair of coupling member 10' and the overshot coupling member 10'', beneath the next interstitial ground double weft 3*i'* and over the following double weft 3*i''*.

The pattern A then repeats.

Naturally, with an offset of two weft picks and a pattern embracing four coupling members, four connecting yarns 5–8 are preferred although a greater number or fewer number of connecting warp yarns may be used and two or more connecting yarns may be combined into a group acting as a single connecting yarn pass. The discrete warp pockets of the ground weft are represented at 13 in FIG. 3.

The interstitial ground wefts 3'' engaged by the connecting warp yarns 5–8 are drawn away from the ground weave of the tape substantially to or beyond the median plane MP of the coupling element.

We claim:

1. In a slide fastener having a stringer half formed with a woven ground-weave tape and a continuous monofilament coupling elements formed by weaving and woven into said tape during the weaving thereof and wherein said tape has a ground weave comprising ground warp yarns forming warp pockets receiving ground-double wefts reaching to a longitudinal edge of the tape and formed by a continuous ground weft yarn, said coupling element comprising a multiplicity of double-weft coupling members spaced apart along said edge with each coupling member having a coupling head projecting beyond said edge, and a pair of shanks having superposed projections in a slide fastener plane overlying a portion of said tape adjacent said edge with connecting parts bridging the shanks of successive coupling members, the improvement wherein said coupling element is secured to said tape on said portion by a plurality of connecting warp yarns and such that the shanks of each coupling member form a double weft interwoven with said connecting warp yarns and respective double wefts underlying the shanks of each coupling member while interstitial ground double wefts lie between the coupling members, said connecting warp yarns being offset longitudinally from one another with a stagger of two picks and each overshooting both shanks of a pair of coupling members, overshooting both shanks of the next coupling member and undershooting both shanks of a further coupling member in a repeating pattern along the length of said tape, each connecting warp yarn passing under an interstitial ground a double weft between each of said pairs of coupling members and the successive next coupling member, the interstitial double ground wefts engaged by said connecting warp yarns being drawn away from the ground weave at least to a median plane of the coupling element.

2. The improvement defined in claim 1 wherein in each of said patterns, the respective connecting warp passes of a respective interstitial double weft yarn between the respective next coupling member and further couplings member.

* * * * *